United States Patent [19]

Williams

[11] Patent Number: 5,003,647

[45] Date of Patent: Apr. 2, 1991

[54] DISPOSABLE SHOWER LINER

[76] Inventor: James Williams, 12 Fred St., Burlington, Mass. 01803

[21] Appl. No.: 384,557

[22] Filed: Jul. 24, 1989

[51] Int. Cl.[5] ..... A47K 3/02; E04F 13/08

[52] U.S. Cl. ..... 4/559; 4/580; 4/605; 4/614; 4/DIG. 18; 52/391; 52/DIG. 4; 160/368.1; 160/402; 160/DIG. 16; 24/303; 248/309.4

[58] Field of Search ..... 4/580, 581, 582, 583, 4/605, 608, 609, 614, 610, DIG. 18, 559, 612; 52/390, 391, DIG. 4, 35; 160/DIG. 6, DIG. 16, 368.1, 380, 402; 24/303; 248/206.5, 309.4

[56] References Cited

U.S. PATENT DOCUMENTS

| | | | |
|---|---|---|---|
| 1,198,227 | 9/1916 | Hinchey | 160/368.1 |
| 2,925,631 | 2/1960 | Larson et al. | 52/390 |
| 3,000,016 | 9/1961 | Ridge | 4/608 X |
| 3,204,601 | 9/1965 | Staver | 248/309.4 X |
| 3,282,328 | 11/1966 | Mushro et al. | 24/303 X |
| 3,365,684 | 1/1968 | Stemke et al. | 4/608 X |
| 3,378,974 | 4/1968 | Bush, Jr. | 52/DIG. 4 X |
| 3,931,651 | 1/1976 | Weir | 4/580 |
| 3,938,200 | 2/1976 | Roberts et al. | 4/DIG. 18 X |
| 4,067,071 | 1/1978 | Altman et al. | 4/595 X |
| 4,088,174 | 5/1978 | Edwards | 4/608 X |
| 4,299,064 | 11/1981 | Daniels | 52/35 |
| 4,405,108 | 9/1983 | Muirhead | 248/309.4 |
| 4,671,026 | 6/1987 | Wissinger | 52/35 |

FOREIGN PATENT DOCUMENTS

| | | | |
|---|---|---|---|
| 2744673 | 4/1979 | Fed. Rep. of Germany | 52/390 |
| 2903213 | 7/1980 | Fed. Rep. of Germany | 52/390 |
| 3134256 | 3/1983 | Fed. Rep. of Germany | 4/580 |
| 28413 | 3/1979 | Japan | 52/DIG. 4 |
| 8400969 | 10/1985 | Netherlands | 4/610 |

*Primary Examiner*—Henry J. Recla
*Assistant Examiner*—Robert M. Fetsuga

[57] ABSTRACT

A magnetic fastening device for releasably attaching a shower liner to a shower wall comprising a wall mounting member having a back flat portion adapted for attachment to a shower wall, bearing a node or hook directed away from the member into the shower area and the upper front portion sloping toward the rear of the member and in the direction of the shower wall along with an unmounted member for mating with the wall mounting member bearing an aperture to receive the protruding node or hook on the wall mounting member, and its upper portion sloping toward the shower wall to closely mate with the mounting member; the wall mounting and unmounted members being magnetically attracted one to the other. A kit can be made comprising this magnetic fastening device with a shower liner.

6 Claims, 14 Drawing Sheets

FIG. 9
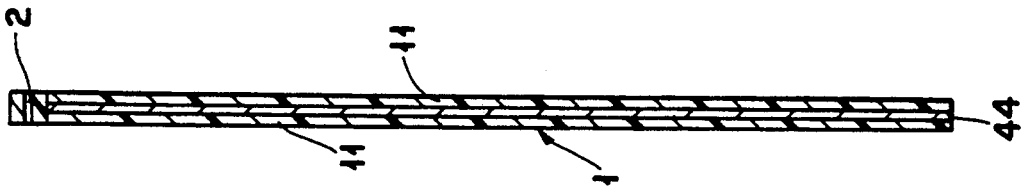
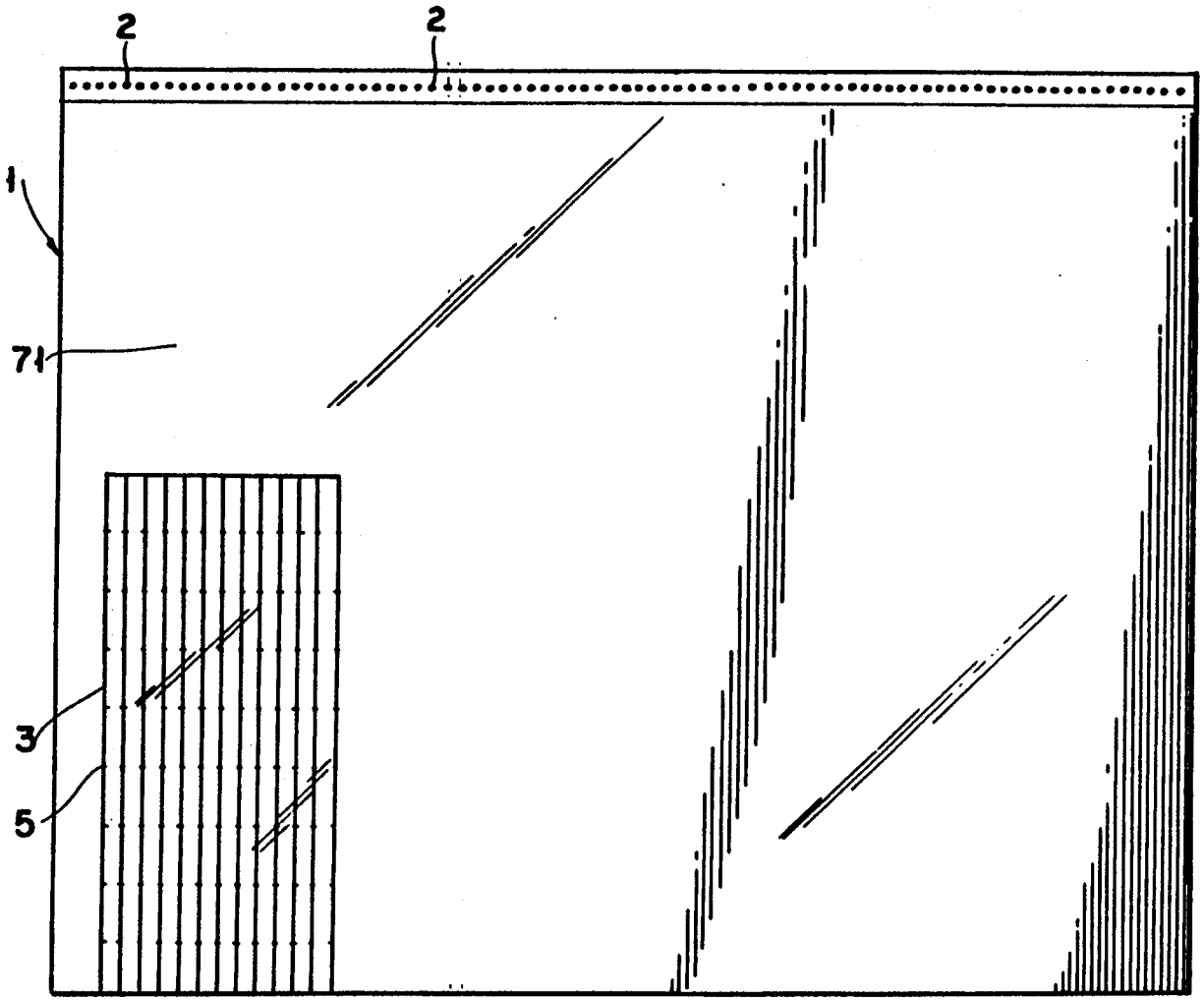
FIG. 8

DISPOSABLE SHOWER LINER

BACKGROUND OF THE INVENTION

The invention was created as a response to the frustration and costly repairs that were done to the walls of a tub/shower enclosure and also to the walls of a free standing shower stall enclosure in my home. I set out to create a device that would prevent this unnecessary and untimely deterioration, (caused by hot soapy water, dirt and soap scum, and daily use) from occuring in the future. More importantly, I also wanted a means so that scrubbing and cleaning, along with routine maintenance of a tub/shower or free standing shower stall would no longer be necessary; and the use of harsh chemical cleaners, (an environmental hazard and waste of natural resources) and gallons of water to rinse these areas after cleaning would be substantially reduced or eliminated.

1. Field of the Invention

The invention relates to a flexible, disposable liner, (meant to be installed, soiled through use, removed, discarded, and replaced); having a preferably transparent, weakened portion for openings to be made that allow user access to water handles and water spigots; that is releasably attached to the walls, preferably by magnetic pads, preferably with a hook that vertically suspends and secures the liner on a series of apertures along the liner's entire top length, and preferably also with magnetic pads that horizontally secure the liner to the bottom of the walls.

2. Description of The Related Artwork

U.S. Pat. No. 2,809,379 is a Portable Shower Stall which differs from my invention in that the full use of the tub/shower area cannot be used, and it doesn't have the pleasing appearance that the present invention has.

U.S. Pat. No. 4,671,026 is a Bathtub Wall Surround Kit and Seals that is different from the present invention in that it is not disposable, is not flexible, and requires cleaning and maintenance.

SUMMARY OF THE INVENTION

The invention relates to a flexible, disposable shower liner set up in an already existing tub/shower enclosure, or free standing shower stall. The present invention works equally well in a tub/shower or shower stall with water handles and water spigots on either a left end wall enclosure, or a right end wall enclosure because the liner is reversible or usable on either side.

The liner is made from a water impermeable material, preferably laminated over an inner heat reflective layer which reflects and redirects the heat of hot water and of the body back to the user, (saving energy by using lower water temperatures to achieve the same level of comfort previously desired prior to liner use) and away from the walls where it is otherwise absorbed. An inner heat reflective material is also used to create a very malleable liner, i.e., one which readily conforms to any and all wall surfaces, and provides a very close fit against them.

The liner has a weakened area that is preferably transparent to give the user a view, a place, and the means to make openings in the liner which provide user access to water handles and water spigots. The weakened area is preferably achieved by perforations in the liner at this area.

The liner is removably attached so that a used and soiled liner may be quickly and easily replaced with a clean liner. The method of upper attachment preferably uses pairs of magnetic pads, one having a node, the other a cavity to suspend and support the liner upon a series of apertures that run along its entire top length. The upper method of attachment uses magnetic pads designed to bend the liner and bring it as close to the wall as possible to reduce or eliminate any condensation which would attempt to get behind the liner and onto the walls. Either one or both of the pads may be magnetic; but at least one of the pads must be magnetic.

Pairs of magnetic pads, (without nodes and cavities) are also preferably used at the bottom of the liner, preferably vertically in line with their upper magnetic pads, to secure and maintain alignment of the liner. As mentioned before, either one or both of the pads may be magnetic, but at least one of the pads must be magnetic.

Ideally, the liner and magnetic pads will be produced in a variety of colors to match any bathroom decor.

BRIEF DESCRIPTION OF THE DRAWINGS

FIG. 8 is a perspective view of the disposable liner unrolled and unfolded.

FIG. 9 is an expanded cross sectional view of the liner.

FIG. 32 is a rear perspective view of the liner installed in an already existing tub/shower enclosure.

DETAILED DESCRIPTION OF THE DRAWINGS

Figure 1:
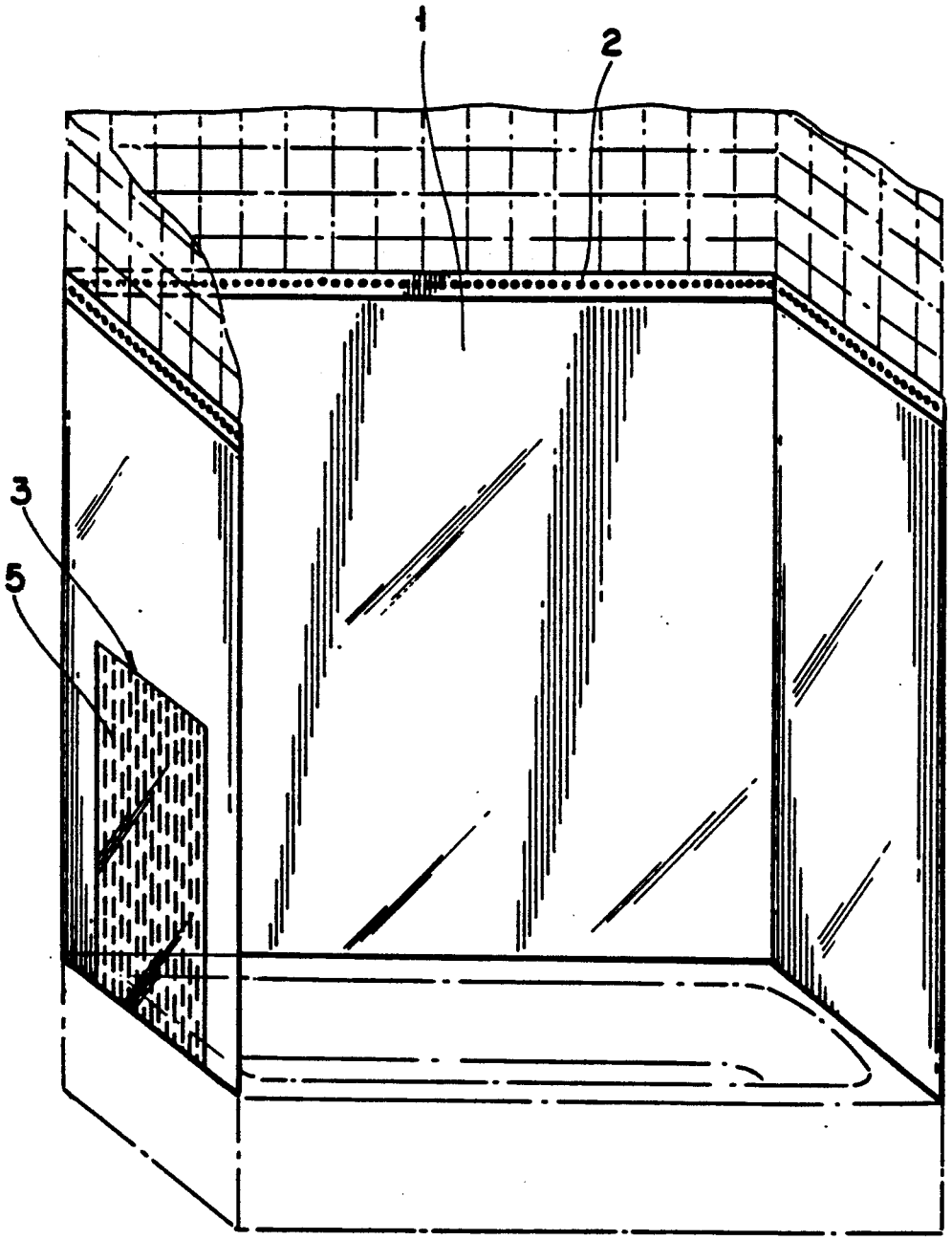
FIG. 1 is a perspective view of an installed disposable liner set up in an already existing tub/shower enclosure to be fitted over water handles and a water spigot on the left side end wall in accordance with the present invention.

As shown in FIG. 1, the liner is 1; the apertures are 2; the left end wall transparent weakened area is 3; and perforations 5.

Figure 2:
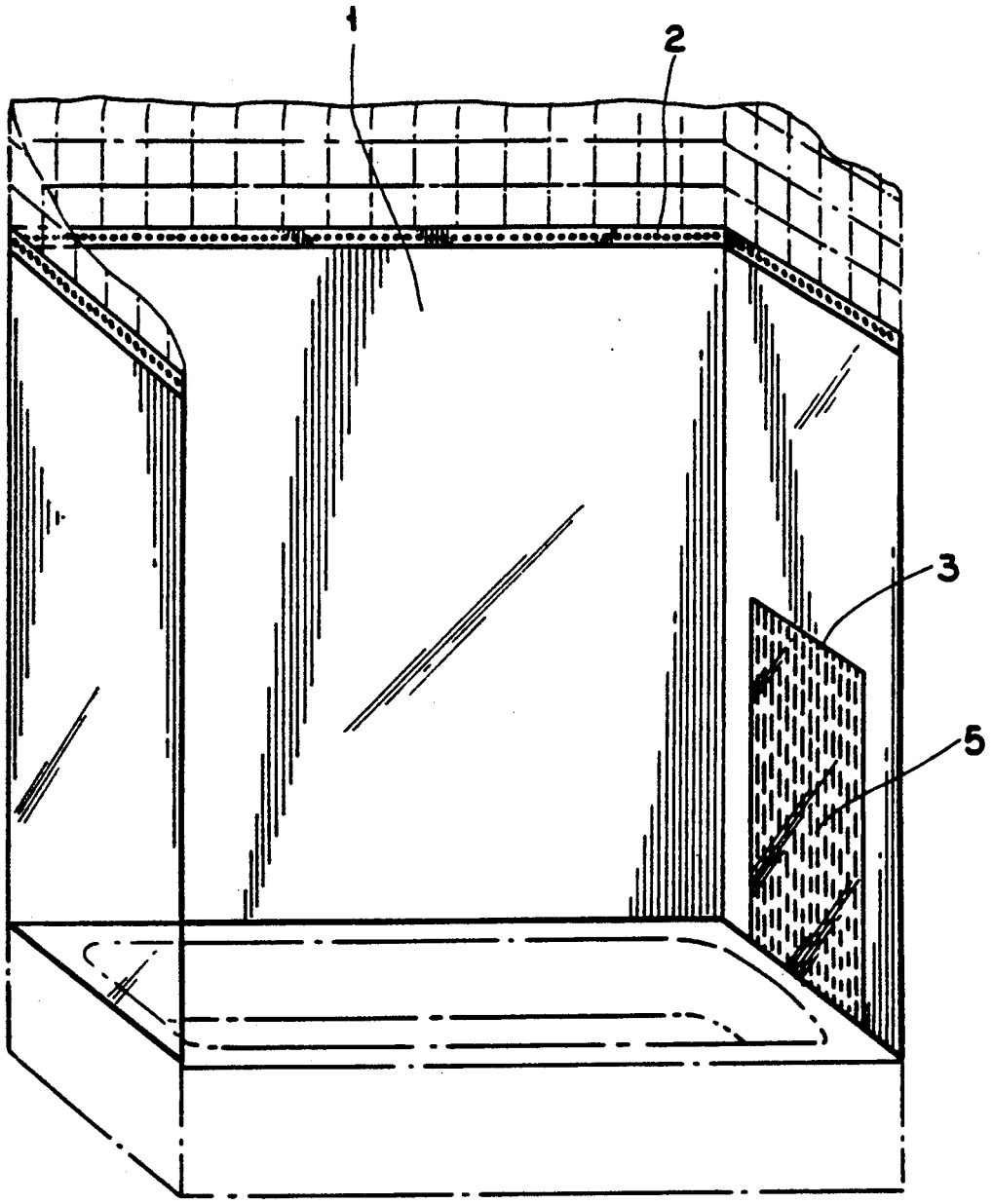
FIG. 2 is a perspective view of an installed disposable liner set up in an already existing tub/shower enclosure to be fitted over water handles and a water spigot on the right side end wall in accordance with the present invention.

As shown in FIG. 2, the liner is 1; apertures 2; the right end wall transparent weakened area is 3; and perforations 5.

Figure 3:
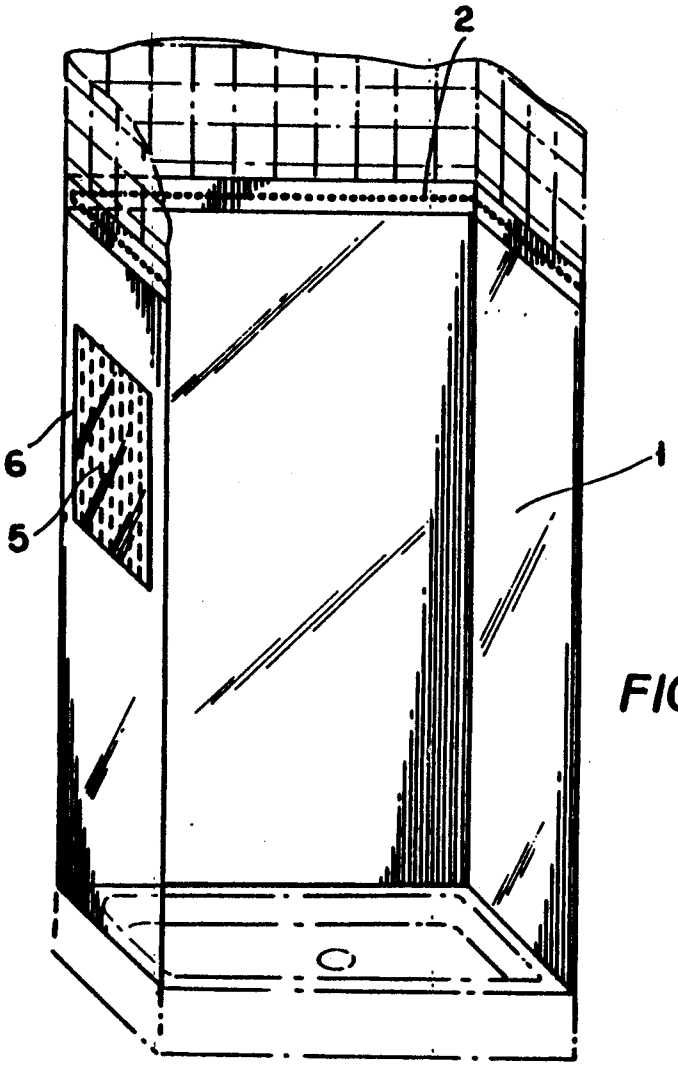
FIG. 3 is a perspective view of an installed disposable liner set up in an already existing free standing shower stall to be fitted over a water handle on the left side end wall in accordance with the present invention.

As shown in FIG. 3, the liner is 1; apertures are 2; left end wall transparent weakened area is 6; and perforations 5.

Figure 4:
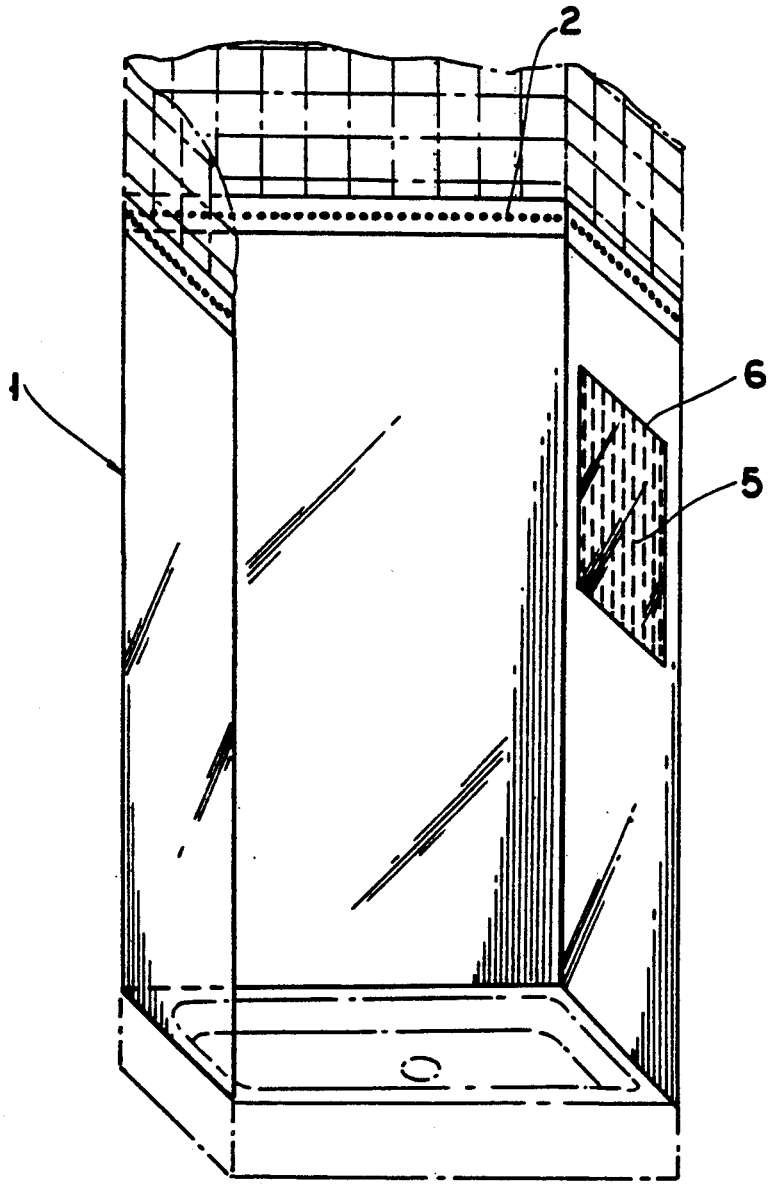
FIG. 4 is a perspective view of an installed disposable liner set up in an already existing free standing shower stall to be fitted over a water handle on the right side end wall in accordance with the present invention.

As shown in FIG. 4, liner is 1; apertures are 2; right transparent weakened area is 6; and perforations 5.

Figure 5:
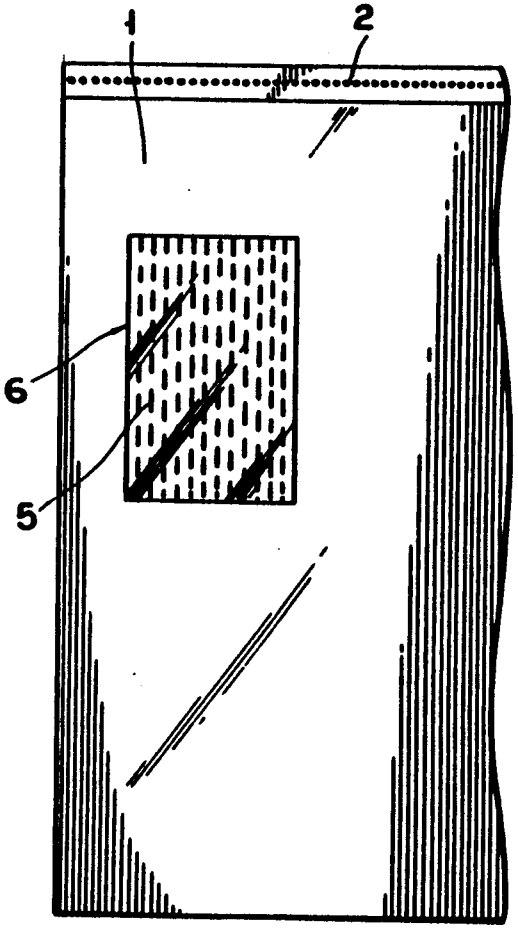
FIG. 5 is a fragmentary perspective view of the disposable liner to be used in a free standing shower stall with its transparent, weakened area of perforations, and the series of apertures which run along the entire top length of the liner.

As shown in FIG. 5 liner is 1; apertures 2; transparent weakened area 6; and perforations 5.

Figure 6:
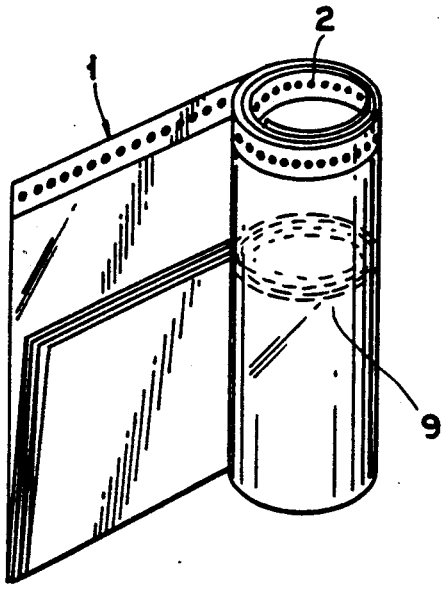
FIG. 6 is a perspective view of the liner in its rolled and folded form prior to installation.

As shown in FIG. 6, the liner 1; is shown in its rolled and folded form 9; apertures 2.

Figure 7:
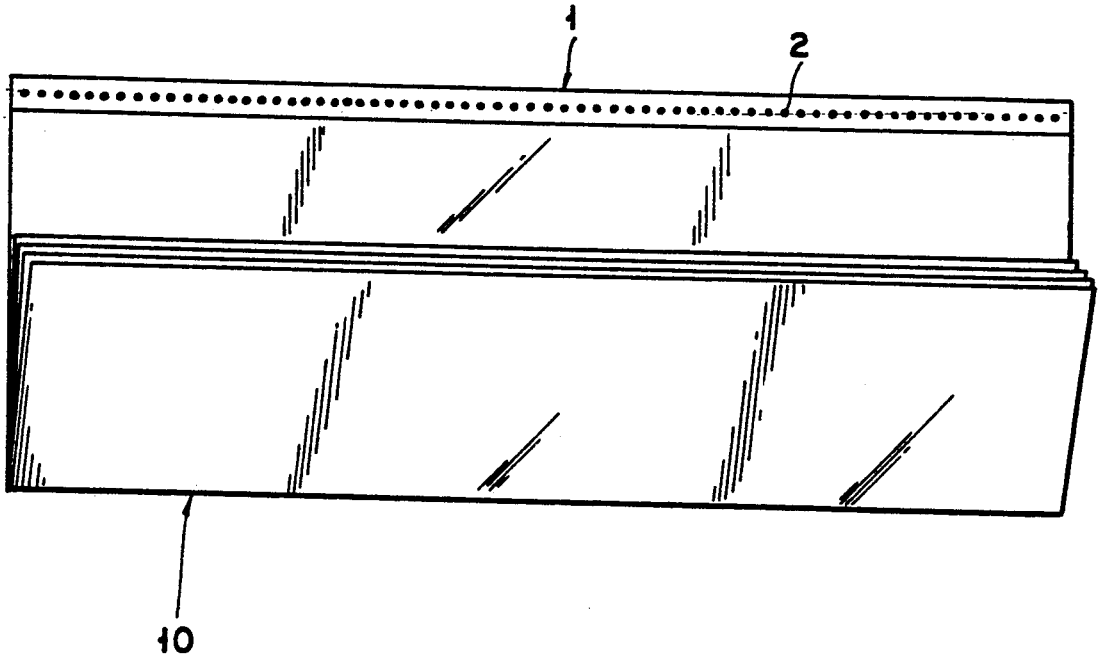
FIG. 7 is a perspective view of the disposable liner unrolled but still folded.

As shown in FIG. 7, liner 1; is shown in its unrolled and folded form 10; apertures 2.

As shown in FIG. 8, liner 1; unrolled and unfolded 71; apertures 2; transparent weakened area 3; perforations 5.

As shown in FIG. 9, the two, 2 mil layers of polyethelyne 11; are laminated upon an inner heat reflective layer 44.

Figure 10:
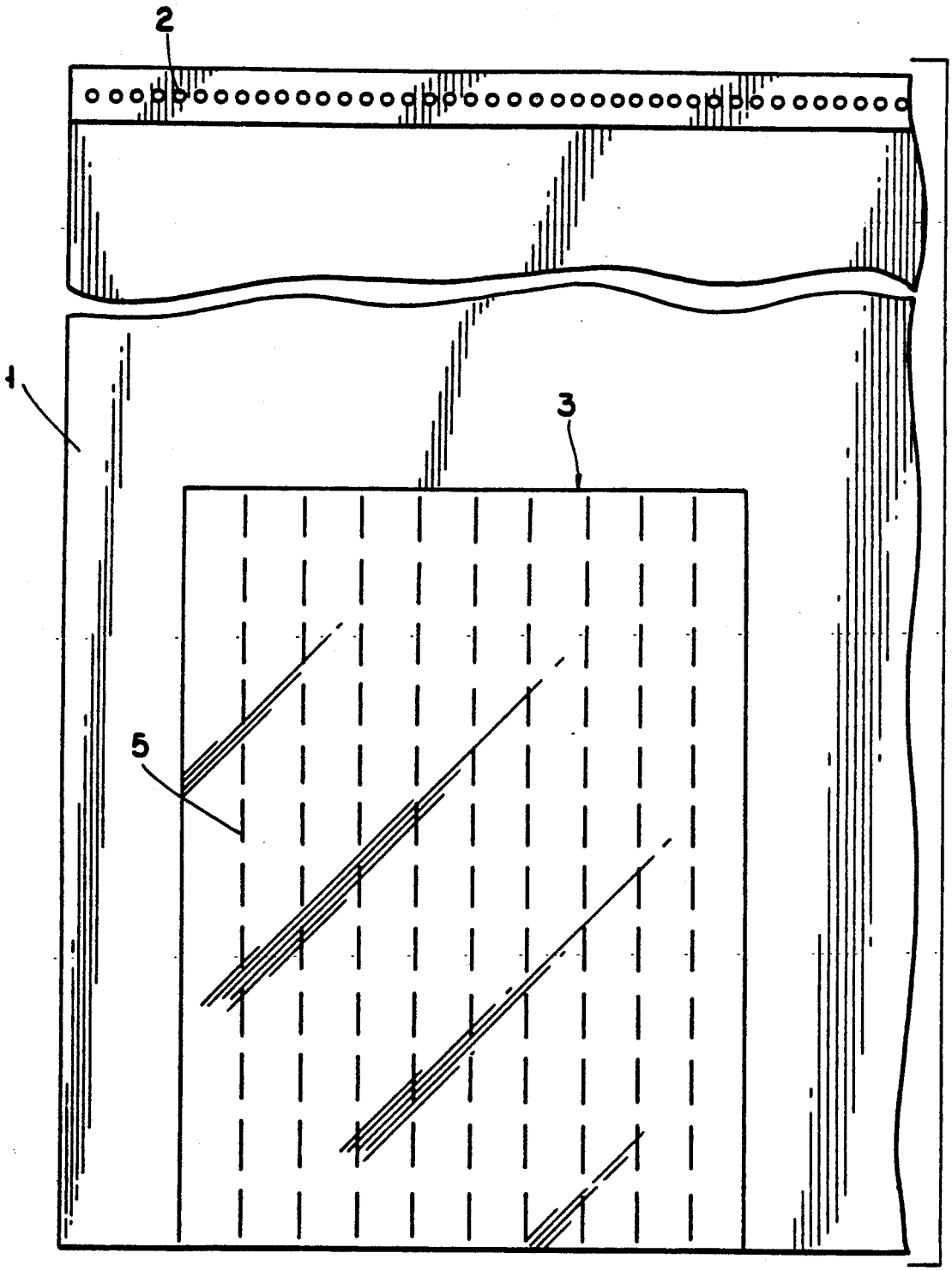
FIG. 10 is a fragmentary perspective view of the liner to be used in a tub/shower enclosure showing the transparent, weakened area of perforations, and the series of apertures which run along the entire top length of the liner.

As shown in FIG. 10, liner 1; apertures 2; transparent weakened area 3; and perforations 5.

Figure 11:
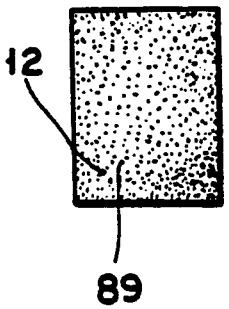
FIG. 11 is a rear perspective view of the upper, wall mounted magnetic pad with its adhesive backing.

FIG. 11 shows the adhesive backing 12; of the upper, wall mounted magnetic pad 89.

Figure 12:
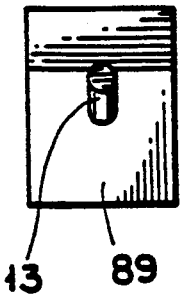
FIG. 12 is a front perspective view of the upper, wall mounted magnetic pad with its protruding node.

FIG. 12 shows the protruding node 13; on the upper, wall mounted magnetic pad 89; with its adhesive backing 12.

Figure 13A:
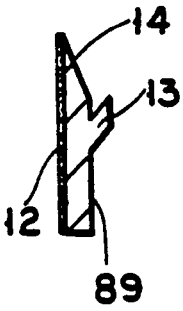
FIGS. 13, 13A and 13B are cross sectional views of the upper, wall mounted magnetic pad, with its adhesive backing, its protruding node, and its inwardly sloping, decreasing surface area.
Figure 13:
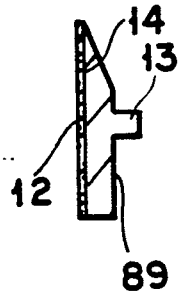
Figure 13B:
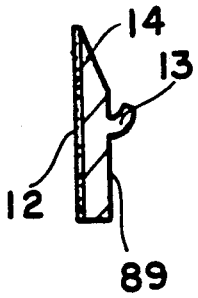

FIGS. 13, 13A and 13B show the protruding node 13; of the upper, wall mounted magnetic pad 89; with its adhesive backing 12; with the decreasing, inwardly sloping surface area 14.

Figure 14:
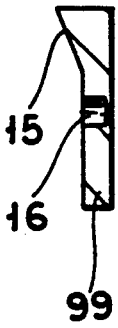
FIGS. 14, 14A and 14B are cross sectional views of the upper, unmounted magnetic pad with its outwardly sloping, increasing surface area.
Figure 14A:
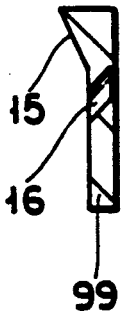
Figure 14B:
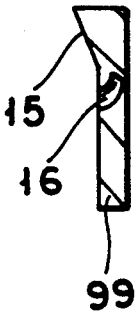

FIGS. 14, 14A and 14B show the upper, unmounted magnetic pad 99, that secures the liner horizontally with its increasing, outwardly sloping surface area 15.

Figure 15:
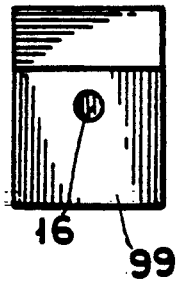
FIG. 15 is a rear perspective view of the cavity in the center of the upper, unmounted magnetic pad.

FIG. 15 shows the cavity 16; which receives the protruding node 13.

Figure 16:
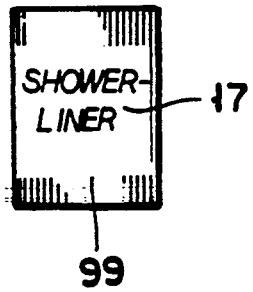
FIG. 16 is a front perspective view of the upper, unmounted magnetic pad showing the invention logo upon it.

FIG. 16 shows the upper, unmounted magnetic pad 99, which the user views while in the shower, preferably having the invention logo 17.

Figure 17A:
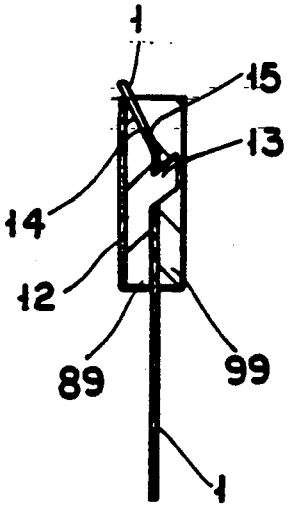
FIGS. 17 and 17A are cross sectional views of the two upper magnetic pads mated to one another; (by means of magnetic attraction), showing the liner suspended upon the node of the wall mounted, magnetic pad, with its inwardly sloping, decreasing surface area, and protruding node inserted into the unmounted magnetic pad with its cavity and outwardly sloping, increasing surface area; bending and bringing the liner as close to the wall as possible. The liner extends just above and beyond the pair of upper magnetic pads.
Figure 17:
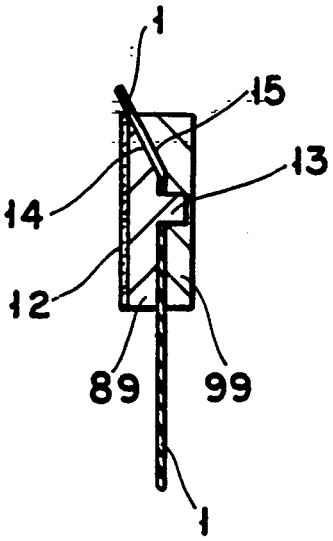

FIGS. 17 and 17A show the liner 1; being suspended upon the protruding node 13; of the upper, wall mounted magnetic pad 89; with its adhesive backing 12; attached to the wall, and its decreasing, inwardly sloping surface area 14; mating with the upper, unmounted magnetic pads 99; cavity 16; and its increasing, outwardly sloping surface area 15.

Figure 18:
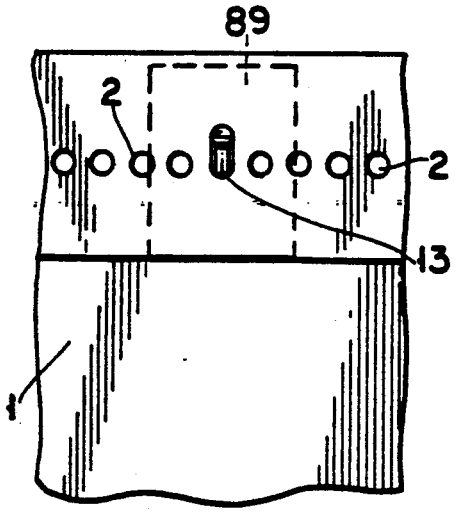
FIG. 18 is a fragmentary perspective view of the liner in front of, and suspended upon the upper, wall mounted magnetic pad's protruding node.

FIG. 18 shows the liner 1; with the series of apertures 2; hooked onto the upper, wall mounted magnetic pads 89; protruding node 13.

Figure 19:
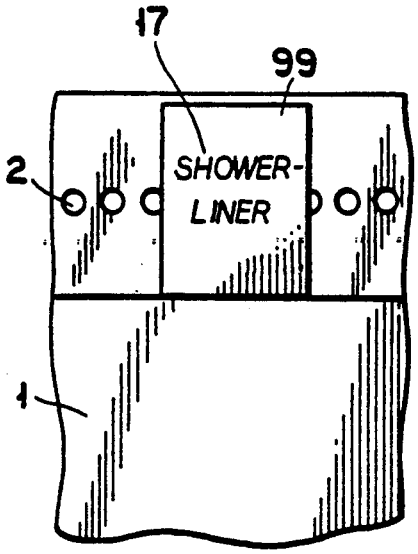
FIG. 19 is a fragmentary perspective view of the disposable liner horizontally secured, (by means of magnetic attraction) by the upper, unmounted magnetic pad.

FIG. 19 shows the upper, unmounted magnetic pad 99; which preferably has the invention logo 17; upon it, magnetically securing the liner horizontally to the wall.

Figure 20:
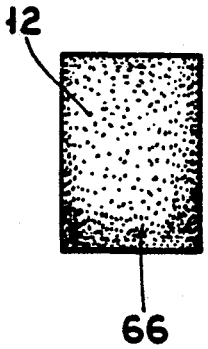
FIG. 20 is a rear perspective view of the lower, wall mounted magnetic pad with its adhesive backing showing.

FIG. 20 shows the adhesive backing; on the lower, wall mounted magnetic pad 66.

Figure 21:
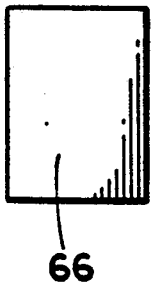
FIG. 21 is a front perspective view of the lower, wall mounted magnetic pad.

FIG. 21 shows the other side of the lower, wall mounted magnetic pad 66.

Figure 22:
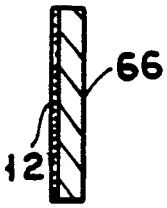
FIG. 22 is a cross sectional view of the lower, wall mounted magnetic pad, with its adhesive backing showing.

FIG. 22 is a side view showing the lower, wall mounted magnetic pad 66; with its adhesive backing 12.

Figure 23:
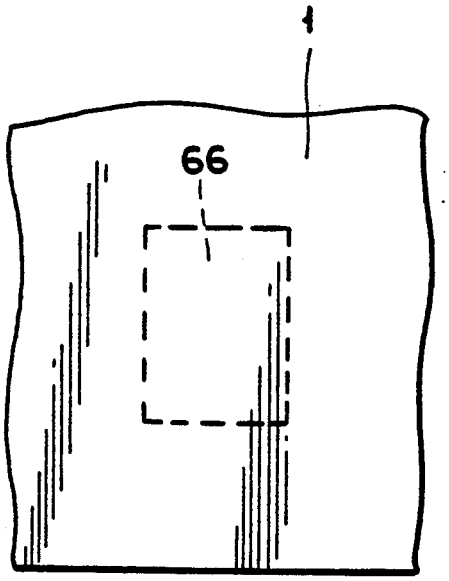
FIG. 23 is a fragmentary perspective view of the liner in front of the lower, wall mounted magnetic pad.

FIG. 23 shows the liner 1; over and in front of, the lower, wall mounted magnetic pad 66.

Figure 24:
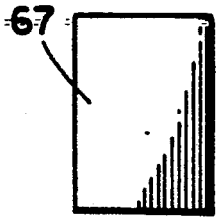
FIG. 24 is a rear perspective view of the lower, unmounted magnetic pad.

FIG. 24 is a rear view of the lower, unmounted magnetic pad 67.

Figure 25:
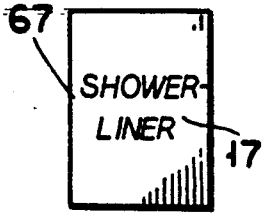
FIG. 25 is a front perspective view of the lower, unmounted magnetic pad that preferably has the invention logo upon it.

FIG. 25 shows the front of the lower, unmounted magnetic pad 67; which preferably has the invention logo 17; upon it.

Figure 26:
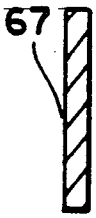
FIG. 26 is a cross sectional view of the lower, unmounted magnetic pad.

FIG. 26 is a side view of the lower, unmounted magnetic pad 67.

Figure 27:
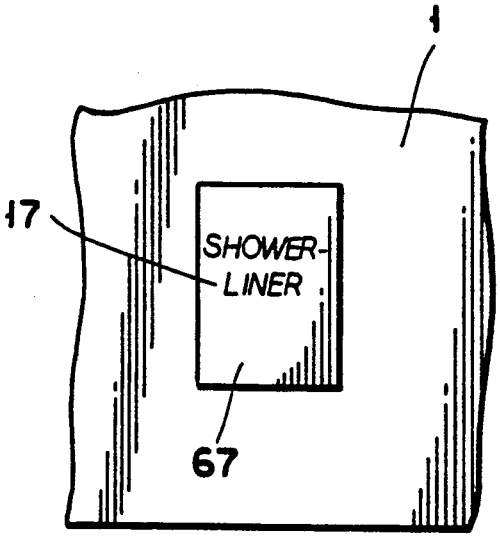
FIG. 27 is a fragmentary perspective view of the disposable liner horizontally secured between the two lower magnetic pads.

FIG. 27 shows the liner 1; now magnetically secured, (horizontally) by the lower, unmounted magnetic pad 67; with the invention logo 17; showing.

Figure 28:
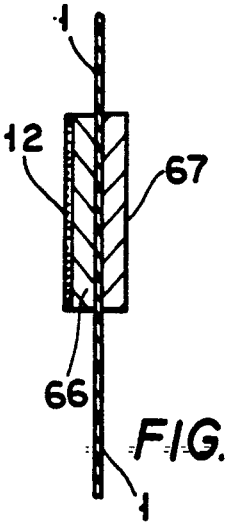
FIG. 28 is a cross sectional view of the liner horizontally secured, (by means of magnetic attraction) between the pair of lower magnetic pads.

FIG. 28 shows the lower, wall mounted magnetic pad 66; with the adhesive backing 12; magnetically securing the liner 1; between the lower, unmounted magnetic pad 67; which preferably has the invention logo 17; on it.

Figure 29:
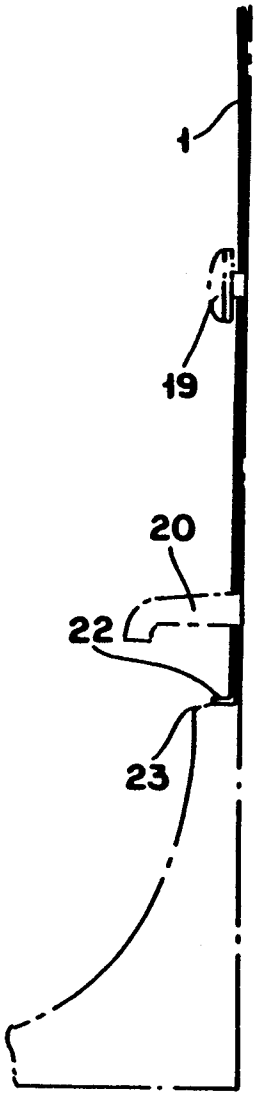
FIG. 29 is a cross sectional view illustrating a water handle and a water spigot extending through and beyond the disposable liner.

FIG. 29 shows the liner 1; extending through and beyond the water handle(s) 19; and the water spigot 20; now accessible to the user. The end wall drip edge 22; is resting upon the sill of the tub 23.

Figure 30:
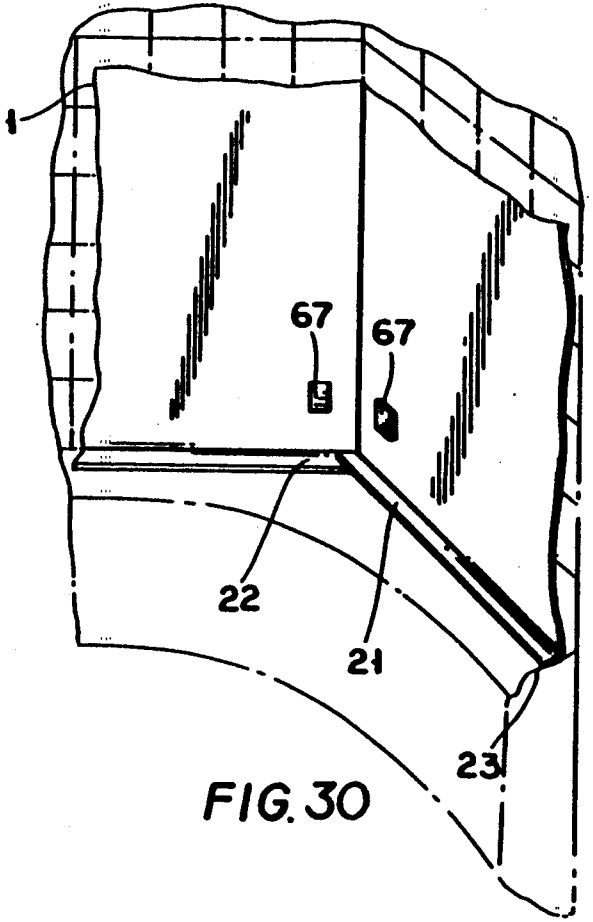
FIG. 30 is a fragmentary perspective view of the side wall drip edge overlapping the end wall drip edge, and resting upon the sill of the tub.

FIG. 30 shows the liner 1; with the side wall drip edge 21; lying over the end wall drip edge 22; and resting upon the sill of a tub 23.

Figure 31:
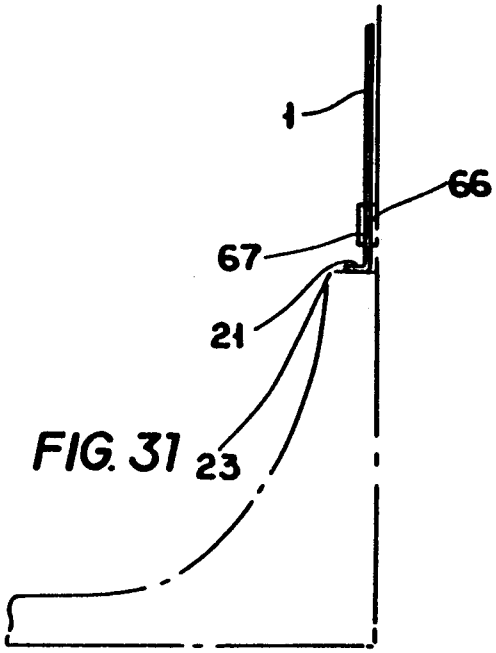
FIG. 31 is a cross sectional view of the liner horizontally secured between the two lower magnetic pads, showing the side wall drip edge resting upon the sill of the tub.

FIG. 31 shows the liner 1; magnetically attached and horizontally secured between the two lower magnetic pads 66 and 67; and the side wall drip edge 21; now resting upon the sill of the tub 23.

FIG. 32 is a rear perspective view of the disposable liner 1; installed in a tub/shower enclosure with water handle(s) 19; and a water spigot 20; on the left end wall.

Figure 33:
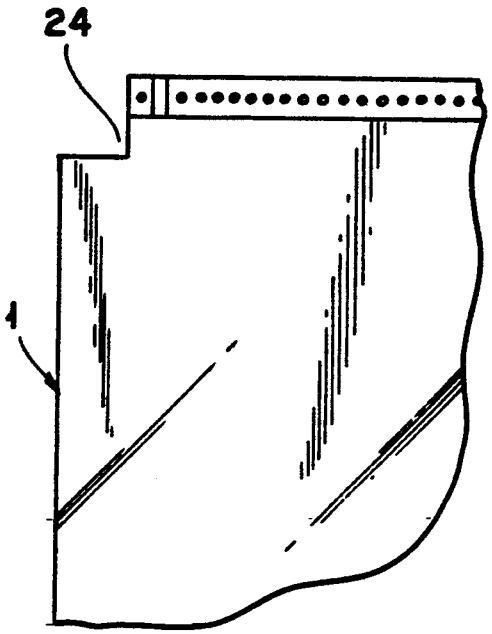
FIG. 33 is a fragmentary perspective view of the top corner of the liner after being notched by the user.

FIG. 33 shows the top of the liner 1; notched 24; by the user.

Figure 35:
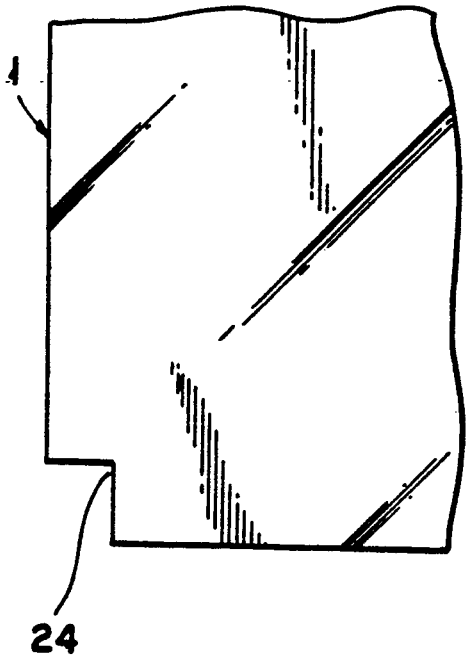
FIG. 35 is a fragmentary perspective view of the bottom corner of a liner after being notched by the user.

FIG. 35 shows the bottom of the liner 1; notched 24; by the user.

Figure 37:
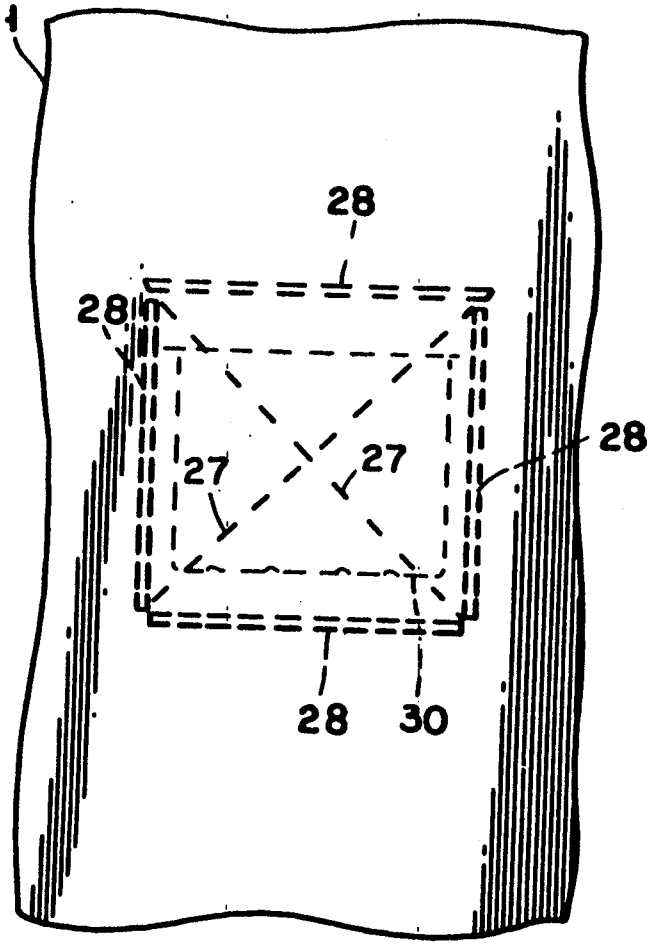
FIG. 37 is a fragmentary perspective view of the four pairs of magnetic bands with adhesive backings that are placed in close proximity to the soap dish; one on the top and bottom, and one on each side of the soap dish. Also shown is the "X" cut made by the user to access the soap dish.

FIG. 37 shows the liner 1; with the "X" cut 27; and the four magnetic bands with adhesive backings 28; that are attached to the wall, around and in close proximity to the soap dish 30.

Figure 38:
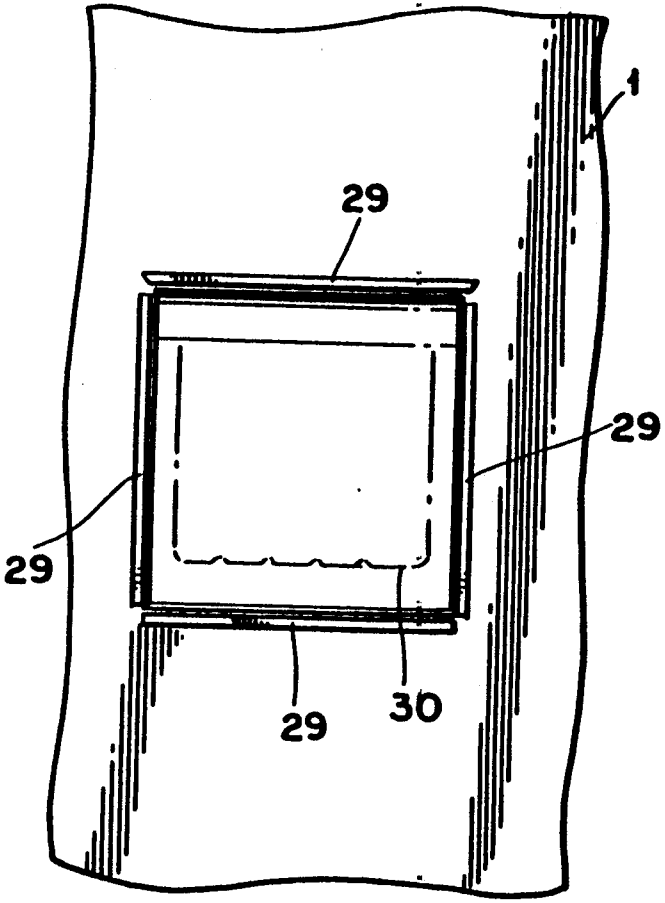
FIG. 38 is a fragmentary perspective view of a soap dish extending through and beyond the disposable liner, which is in front of the adhesively attached magnetic bands, and secured horizontally; (by means of magnetic attraction), between the other four magnetic bands that are in front of the liner itself.

FIG. 38 shows the four, opposing magnetic bands 29; in front of the liner 1; and magnetically attached to the four magnetic bands with non water soluble adhesive backings 28; in close proximity to the soap dish 30; magnetically securing the liner 1; horizontally to the wall.

Figure 39:
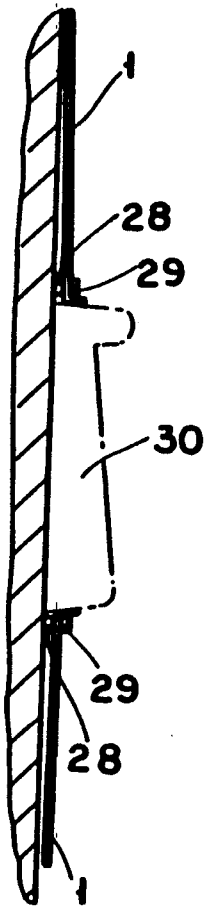
FIG. 39 is a cross sectional view of the disposable liner in front of the soap dish, that is now fully accessible to the user of the shower and horizontally secured, by means of magnetic attraction.

FIG. 39 shows the soap dish 30; extending through and beyond the liner 1; which is magnetically secured between magnetic bands 28 and 29; horizontally to the wall.

Embodiments of the Invention

Making the liner out of a flexible material offers a variety of beneficial features.

First, a flexible material would enable the liner to be neatly rolled and folded for packaging purposes.

Second, the compact form offers the user an easily handled, lightweight product, preferably of a material that doesn't wrinkle, and which when ready to be installed, would be unrolled and unfolded.

Third, the flexible material enables the liner to readily conform to any and all walls and their corresponding corners.

A variety of materials may be used to make the flexible liner. There are many readily available plastics which meet the requirement of flexibility, and would easily laminate themselves over an inner heat reflective material. The material of choice may be transparent, translucent, opaque, colored, have some texture to it, or even have some sort of design on it that would match the decor or the bathroom.

The liner should be of sufficient height that it will fit and be usable in all, or almost all industry standard 5 foot tub/shower enclosures, and any free standing shower stall. In order to arrive at a minimum acceptable overall length, it was necessary to measure a great many enclosures. An industry standard 5 foot tub/shower enclosure consists of a side wall measuring approximately 60 inches in length, and two end walls measuring approximately 30 inches in length each; (these two end walls equal 60 inches). The length of the three walls equal 120 inches and an additional 5 inches on each side would preferably be added to the overall liner length for fitting and trimming. Therefore, a minimum overall liner would preferably be 130 inches in length.

The liner should be high enough to protect the walls from splashing water, but preferably be below the height of a shower head.

The height of the liner would preferably be 57 inches, in order that it accomodate the shortest industry standard, sliding glass shower doors which are 56 inches high; and also create at least a 1 inch drip edge that rests upon the entire length of the sill of the tub. In a tub/-shower enclosure where a shower curtain is being used, the liner would be hidden from sight behind the curtain.

For a free standing shower stall, the length of the liner is normally less than that of a tub/shower enclosure, and the height of the liner would normally be longer than that of a tub/shower enclosure. Since these dimensions may vary to some extent, it is obvious that they would be appropriate to the overall length and height of several free standing shower stall enclosures.

In order to operate the water handles and a water spigot in a tub/shower or free standing shower stall, it is necessary that the water handles and a water spigot pass through and beyond the liner. Therefore, the liner preferably has an oversized weakened area which provides for the user a view, a place, and the means to make openings in the liner to access these water controls. The oversized weakened area is large enough to accomodate any and all water control devices, since the water handles and spigot are placed in a small range; (but a range nevertheless) of possible locations on the appropriate end wall.

The oversized, weakened area of the liner is preferably transparent so that the user can see where to make the appropriate openings as required. If the liner were not transparent, and did not have the oversized weakened area for openings to be made, it could probably still be used, however the absence of these two features would cause an improper fit and most certainly a poor appearance once installed.

The weakened area of the liner generally does not present a problem with leaking water behind the liner and onto the walls, because only a small portion of the liner is actually opened; but more importantly, the force and direction of the water is away from the end wall where the water handles and spigot are located. Since the weakened area of the liner is the same on both sides, it may be positioned in such a fashion that it is reversible and will work in a tub/shower or free standing shower stall whether the water handles and water spigot are on the left end wall, or the right end wall.

Depending on whether the water handles and water spigot are on the left end wall or the right end wall; the liner may be unrolled from left to right or right to left, and work equally well.

The liner is fastened at least on the top, preferably on the bottom, and also possibly in between the top and bottom. There are many methods of attachment, however many of them are ineffective, some are extremely poor, and most impossible for one person to accomplish without assistance; thereby defeating the primary and ultimate purpose of this invention: Convenience!

A wide variety of adhesives could be used to attach the liner at least on the top. A series of strips of preferably non water soluble tape could be used by attaching half of the adhesive strip to a portion of the top of the liner itself, and then pressing the remainder of the strip to the wall at the specified height. This method is rather impractical and ineffective for many reasons. It is not possible for one person to unroll, align, hold and then press the strips onto the liner and then onto and along the wall. The adhesive strips of tape would have to be removed and discarded along with the liner each time it became soiled. Upon removal of the liner, a sticky residue would be left upon the wall and need to be cleaned with some sort of solvent before a new liner could be replaced.

The next possible method of attachment using adhesives could be a continuous, double sided, preferably non water soluble, adhesive band running along the entire top length of the wall; or several discontinuous, double sided, preferably non water soluble adhesive pads placed at the specified height and desired intervals along the top of the wall. Each side of the preferably non water soluble, adhesive; (whether they be a band or pads) would have a protective backing. In either case, the protective backing would be removed on one side of the band or pads before it could be attached to the wall at the specified height and desired intervals. The opposite side of protective backing on either the band or pads, would then be removed prior to unrolling and pressing the liner onto the wall.

Both of these methods are rather ipractical for several reasons. Proper alignment of an adhesive band or pads, or of the liner itself is dificult if not impossible. Poor alignment of either band or pads, or of the liner itself, might require the liner to be removed from the adhesive band or pads, possibly tearing the liner, the adhesives, or both. Upon removal of the liner and adhesive band or pads, a sticky residue must be cleaned with some sort of a solvent before a new liner can be replaced.

A continuous, double sided, preferably non water soluble adhesive band, or several discontinuous, double sided, preferably non water soluble, adhesive pads could be used in a different manner. Instead of attaching the band or pads to the wall before attaching the liner, the band or pads could be attached directly to the top of the liner during the manufacturing process. This method of attachment is also impractical for several reasons. To retain the feature of reversibility, a band or pads would have to be put on both sides of the top of the liner; which is a waste of resources, or it would be necessary to make disposable liners with a band or pads for water handles and a water spigot for left end walls and right end walls. This would surely create confusion during the purchase decision if a potential user does not know which one to buy.

It is dificult for one person to hold and unroll the liner, maintain alignment, remove the protective backing on a band or pads, and press the liner onto the wall; all at the same time. Any misalignment would require the removal of the liner and the possible tearing of the adhesive band or pads, or the tearing of the liner.

During the removal of the liner and its adhesive, it is likely that some of the adhesive would remain on the wall and again require some sort of cleaning with a solvent before a new liner could be replaced.

Adhesives alone, are not a cost effective method, because they must be replaced each time a new liner is to be used. It is also a time consuming process to clean off a sticky residue. Adhesives often do not remain attached to the liner in a warm moist environment.

Another possible method of attachment where adhesive are partially used could be a pair of continuous Velcro bands, preferably with non water soluble, adhesive backings; or several discontinuous pairs of Velcro pads, preferably with non water soluble, adhesive backings. The Velcro bands or pads could be attached, (as previously mentioned) to the wall first and then the liner, or onto the liner itself.

The same problems exist. To retain the feature of reversibility, it would be necessary to manufacture the liner with Velcro pads or a Velcro band on both sides of the liner; or make left end wall liners and right end wall liners. This option is particularly impractical because Velcro is expensive, and as before, each time the liner is soiled and replacement required, the user must replace at least one side of the Velcro band, (if not both) or several Velcro pads, (if not all).

The use of Velcro in either band form or pads, requires two adhesive contacts: one to the Velcro, and one to the wall. As previously mentioned, adhesives do not generally remain attached to the liner in a warm moist environment.

There are a variety of mechanical means of attachment; some of them are very good; (and all are better than the use of adhesives alone) however each lacks certain key features found in the preferred embodiments of this invention.

There could be many methods of attachment where some sort of spring loaded device or tension generating mechanism is used to secure, suspend, or sandwich the top of the liner. Some examples of these might be several clothespin type devices with non water soluble adhesive backings that sandwich the liner in between two fingers. One or both of these fingers could possibly have claws or teeth which pierce the liner, thereby gripping and suspending the liner. It is likely that the force necessary and generated by this type of device would have to be considerable, making it dificult to operate.

Another method using mechanical means could be in the manufacturing of the liner with a series of nodes along the entire top length of the liner which would be pressed into and be received by corresponding receptacles on pads, preferably with non water soluble adhesive backings. This is an impractical method for several reasons. The manufacturing of liners with nodes, particularly if the feature of reversibility was desired, would require that the nodes be on both sides of the top of the liner. If liners with nodes were produced for left end walls or right end walls, the potential problem of purchase decision confusion again exists.

Another possible method of attachment would use a pair of continuous magnetic bands, one with an adhesive backing that would be secured to the wall at the proper height, and the other magnetic band which would sandwich the liner between them as it was unrolled. This would retain the feature of reversibility, but require magnetic bands with strong magnetic forces. It would be dificult for one person to hold the liner and unroll it, while at the same time placing the other magnetic band over the adhesive magnetic band already on the wall behind the liner.

Another possible method would be to encase the top of the liner with a metallic or magnetic band, and secure that to the wall which would have an adhesive backed magnetic or metallic band, already in place.

Discontinuous magnetic pads could be used in combination with a liner or encased within the top of the liner itself, thereby retaining the feature of reversibility, but requiring magnets of even stronger force to ensure that the liner could not be pulled away from the wall and the two magnetically attached magnetic pads; without regard to whether they are magnetic bands or pads.

Another method of mechanical attachment might use a snap closure track, or a series of snap closure pads, preferably with non water soluble adhesive backings, that would close over and down upon the top of the liner. The problem with this type of attachment is that the force required to hold the liner within the mechanism, would have to be so strong; (unless the liner were again pierced with some sort of claws or teeth), that to remove the liner from the snap sort of closure track would be hard if not impossible for elderly, handicapped, arthritic, or otherwise impaired individuals, for whom convenience and simplicity is very important.

One of the better methods of mechanical attachment would be the use of several hooks, preferably with non water soluble adhesive backings placed on the wall at the specified height and desired intervals to suspend the liner. This is a good method because the liner is now easily manufactured by producing it with a series of apertures that run along the entire top length of the liner. Since the apertures are the same on both sides, the liner retains its feature of reversibility. The diameter of the apertures are preferably the same as the diameter of the hooks. Upon installation, the liner is unrolled onto these hooks from left to right, or right to left depending on which end wall the water control devices are on.

While all of the above mechanical means are superior to methods that use adhesives only, they are not the best, and an important feature has not been incorporated in any of them, and that is the necessity to keep the liner as close to the wall as possible to minimize any condensation that would try and get behind the liner.

DESCRIPTION OF THE PREFERRED EMBODIMENTS OF THE INVENTION

The best embodiment for this invention combines several key features found in the previously mentioned mechanical, adhesive, and magnetic methods. The feature of reversibility is extremely important to this invention, and is preferably achieved through the use of a series of apertures that run along the entire top length of the liner, (FIG. 10). The liner is flexible, lightweight, resists wrinkling and is preferably made from a water impermeable material that is laminated over an inner heat reflective material, (FIG. 9). It is also prudent to consider choosing materials that will decompose or be recyclable, as the liner is meant to be a disposable product. Either feature would enhance the marketability of the product, as the current use of chemical cleaners, followed by the rinsing of these surfaces with gallons of water, is hazardous to the environment and truly a waste of resources.

Many readily available plastics exist which meet the criterie above. Each side of the liner preferably has a 2 mil thick layer of polyethelyne, (FIG. 9); which may be transparent, translucent, opaque, have a texture to it, some sort of design on it, or be colored, laminated over a (0.0010 inch) double sided, heat reflective layer of Aluminum Alloy 1100, (FIG. 9).

Aluminum Alloy 1100 is an excellent material. It is lightweight, relatively inexpensive, and has heat reflective properties on both sides. It is the industry standard and ideally suited as an inner heat reflective layer. The malleable nature of Aluminum Alloy 1100 will greatly improve the contouring properties desired in the present invention that must readily conform to various wall surfaces.

The liner is preferably suspended upon about 8 pairs of rectangular magnetic pads; (however the pads do not have to be rectangular, and both do not need to be magnetic—at least one must be magnetic, the other may be made of a material that is magnetically attractive). Each magnet making up a pair has two distinctly different sides.

The first magnet preferably has a non water soluble adhesive backing, and attaches to the wall, (FIGS. 11, 13, and 17) at the specified height and desired interval. The other side of the magnet has a protruding node, (FIGS. 12, 13, and 17); that may or may not be cylindrical, which could possibly slope upwards, and does not have to be magnetic, which works as a hook to suspend the liner. As previously mentioned, the diameter of the hooks are preferably the same as the diameter of the apertures along the entire top length of the liner. This provides excellent vertical support, and makes it very easy to handle the liner as it is unrolled.

The second magnet in the pair also has two distinctly different sides. The first side has a cavity 16, (FIG. 15) which receives the node suspending the liner and is filled by it. The liner is now firmly supported horizontally as well as vertically.

The other side of this magnet is preferably encased in a colored material that matches the bathroom decor, matches the color of the liner, and could have the invention logo upon it, (FIGS. 16 and 19).

An extremely important concept of this invention is the need to keep the liner very close to the wall, and preferably just above and beyond the method of attachment. This minimizes any condensation that would try to get behind the liner and onto the walls. This extremely integral concept is achieved by having the upper, wall mounted magnetic pad; (the one with the protruding node) have an inwardly sloping, decreasing upper surface (FIG. 13) adapted to closely mate to the second magnetic pad; (the one with the cavity) which has an outwardly sloping, increasing surface area, (FIG. 14). The key point here is that the mating of the eight pairs of magnetic pads, in effect, bends the liner in towards the wall, (FIG. 17) thereby bringing it as close to the wall as possible and minimizing any condensation which would attempt to get behind the liner and onto the walls. The apertures in the liner can be placed, if desired, so that when the liner hangs on the protruding node which is acting like a hook, an upper portion of the liner protrudes and is forced against the shower wall.

As mentioned before, either one or both of the magnetic pads may be magnetic, but at least one of the pads has to be magnetic. The magnetic pads need not be rectangular, they may be any shape, and the method preferred is not the only means to bend the liner in towards the wall. Two magnetic devices, one that is concave, the other convex, would effectively bend the liner in towards the wall. The key is . . . bring the liner as close to the wall as possible.

Another important feature to note is that the entire top length of the liner completely covers and extends beyond and above the eight pairs of magnetic pads, (FIG. 17); those with the node that are attached to the wall, thereby bringing the liner even closer to the wall. More importantly though, this acts as a shield against any moisture which might deteriorate the adhesive bond on the magnetic pad attached to the wall; (or any other device that was used).

Any other means to suspend the liner where the suspending device is above the liner, place the device in an environment that is wet and warm and could possibly deteriorate the adhesive bond between the wall and the device itself.

It is preferable to hold the liner on the bottom of the wall as well as the top. This is preferably achieved by using 8 pairs of magnetic pads at the bottom of the wall (FIGS. 23 and 27). The lower, wall mounted magnetic pads, preferably have non water soluble adhesive backings, (FIGS. 20, 22, and 28) and are preferably attached vertically in line with their corresponding upper 8 pairs of pads.

When the liner is unrolled and unfolded upon the entire wall, a means now exists to secure the liner horizontally, (FIGS. 27 and 28). This prevents any billowing of the liner away from the wall. This is the best method for securing the liner horizontally.

Any method of attachment which simply uses an adhesive only to secure the bottom of the liner will fail. If for any reason the liner is pulled away from the wall, (on the bottom) it is likely that the adhesive would also pull away from the wall, or from the liner itself.

This potential problem is eliminated because if for any reason the liner is pulled away from the bottom of the wall, the magnets will separate and then once the liner is realigned, the magnetic pads may be easily reseated upon one another. This is an essential and ideally suited feature to this liner, and this feature is not found in any other method of attachment.

Two 45 degree cuts; (in relation to the corners of the wall) are made in the liner by the user, at the corners of the left end wall and side wall, and the right end wall and side wall. These 45 degree cuts in the liner create a drip edge, (FIGS. 29, 30, and 31) which rests upon and along the entire length of the sill of the tub, allowing the side wall drip edge to overlap both end wall drip edges. The drip edge diverts water away from the tub/shower walls and into the tub.

The feature of a drip edge is not necessary, nor is it created in a free standing shower stall enclosure.

It is necessary to make openings in the liner to allow the water handles and spigot to pass through and beyond the liner, allowing the user access to these water control devices. The liner preferably has an oversized weakened area, (FIGS. 5, 8, and 10) which is the same on both sides. This oversized weakened area is preferably transparent, (FIGS. 5 and 8) giving the user a view, a place, and the means to make openings in the liner at the exact locations required to access the water handles and a water spigot.

The transparent, oversized weakened area is preferably large enough to accomodate any and all water control devices, since these devices are placed in a small range, (but a range nevertheless) of possible locations on the appropriate end wall.

The transparent, oversized weakened area of the liner generally does not present the problem of water leaking behind the liner and onto the wall because only a small portion of the liner is actually opened; but more importantly, the force and direction of the water is away from the end wall where the water handles and a water spigot are located.

After the liner is fitted into the corners, (FIG. 30) and the water handles and a water spigot are accomodated, (FIG. 29) the ends of the liner are vertically trimmed top to bottom to create a neat and custom fit in any industry standard 5 foot tub/shower enclosure or free standing shower stall enclosure.

If a shower curtain is being used, the liner is vertically trimmed from top to bottom to a point where the liner extends just beyond the shower curtain.

Where a pair of sliding, glass shower doors (not shown) are being used, the liner is notched at the top, (FIG. 33) and at the bottom, (FIG. 35) so that the sliding glass doors create a seal from top to bottom, left and right when the door is closed on the disposable liner.

A final step in the installation is to make an opening, (if desired) in the liner by the user to access the soap dish. There is no standard range of possible locations where the soap dish is located. It could be on any of the three walls, or not in the enclosure at all; therefore no provision is made during the manufacturing process to accomodate it.

Since it is likely a user may wish to use the soap dish, it is easily accomodated by the use of four pairs of magnetic bands closely placed near the soap dish to hold the liner in place.

The first of four pairs of magnetic bands, preferably having non water soluble adhesive backings, are preferably placed in close proximity to the soap dish, (FIG. 37). Two are preferably placed horizontally: one on the top and one on the bottom; the other two are preferably placed vertically: one on the left side, and one on the right side of the soap dish. An "X" cut is carefully made, (FIG. 37). The liner is generally not transparent in this area. This allows the liner to be opened and permits the soap dish to pass through the liner, (FIG. 39).

The other four magnetic bands now cover the liner, (FIG. 38) and the magnetic force of attraction holds the liner against the wall. Installation is now complete.

I claim:

1. A magnetic fastening device for use in releasably attaching a shower liner to a shower wall comprising:

(a) a wall mounting member
  (i) having a back flat portion adapted for attachment to a shower wall
  (ii) bearing a node directed forwardly of the member and
  (iii) an upper front portion sloping upwardly toward the rear of the member (b) an unmounted member for mating with the wall mounting member
  (i) bearing an aperture to receive the protruding node on the wall mounting member, and
  (ii) an upper portion sloping upwardly toward the mounted member to closely mate with the mounting member (c) said wall mounting and unmounted members adapted to be magnetically attracted one to the other whereby when the wall mounting member is attached to the shower wall a shower liner containing apertures can be hung on its node and maintained securely as close as possible against the shower wall when the unmounted member is placed thereover.

2. A magnetic device according to claim 1 wherein the attachment of the wall mounting member is by a water insoluble adhesive.

3. A magnetic device according to claim 1 wherein the node is directed upwardly to securely hold the shower liner.

4. A disposable shower liner kit comprising in combination

A a liner comprising (a) a flexible substantially rectangular water impermeable sheet adapted to be removably placed over the walls of a shower, (b) means at the beginning portion of the sheet for making openings in the sheet adapted to place the beginning portion over water handles and water spigots to contact the sheet against the shower wall, and (c) a series of spaced apart apertures along the top portion of the liner, B a magnetic fastening device comprising (a) a wall mounting member (i) having a back flat portion adapted for attachment to a shower wall (ii) bearing a node directed forwardly of the member and (iii) an upper front portion sloping upwardly toward the rear of the member (b) an unmounted member for mating with the wall mounted member (i) bearing an aperture to receive the protruding node on the wall mounting member, and (ii) an upper portion sloping upwardly toward the mounted member to closely mate with the mounted member (c) said wall mounting and unmounted members adapted to be magnetically attracted one to the other whereby when the wall mounting member is attached to the shower wall the shower liner apertures can be hung on its node and maintained securely as close as possible against the shower wall when the unmounted member is placed thereover.

5. A liner kit according to claim 4 wherein said flexible sheet is heat reflective.

6. A liner kit according to claim 5 containing at least one more pair of magnetically attractive members, one of said members adapted to be attached to the shower wall, whereby lower portions of the liner can be releasably attached to the shower wall when the attachable member is mounted on the wall and the other member is placed over the liner in a position over the wall mounted member and is magnetically attached to the wall mounted member.

* * * * *